United States Patent [19]

Linnerz et al.

[11] 4,125,068

[45] Nov. 14, 1978

[54] BALING PRESSES FOR THE PRODUCTION OF BOUND BALES

[75] Inventors: Wilhelm Linnerz, Kaarst; Eberhardt Stodt, Düsseldorf; Erwin Kaldenbach, Ratingen, all of Germany

[73] Assignee: Lindemann Maschinenfabrik GmbH, Düsseldorf, Germany

[21] Appl. No.: 858,354

[22] Filed: Dec. 7, 1977

[30] Foreign Application Priority Data

Dec. 12, 1976 [DE] Fed. Rep. of Germany ..... 2656457

[51] Int. Cl.[2] ..... B65B 13/04

[52] U.S. Cl. ..... 100/19 R; 100/295

[58] Field of Search ..... 100/11, 31, 3, 17, 19 R, 100/295, 20, 21, 22, 23, 18

[56] References Cited

U.S. PATENT DOCUMENTS

| | | | |
|---|---|---|---|
| 3,587,448 | 6/1971 | Hemphill | 100/3 |
| 3,895,572 | 7/1975 | Nitschke | 100/3 |

FOREIGN PATENT DOCUMENTS

| | | | |
|---|---|---|---|
| 2,446,953 | 8/1976 | Fed. Rep. of Germany | 100/19 R |

*Primary Examiner*—Billy J. Wilhite

*Attorney, Agent, or Firm*—Toren, McGeady and Stanger

[57] ABSTRACT

A baling press for the production of bound bales of scrap material such as refuse is of the kind which comprises a press box, a press plunger which is movable through the press box to compress refuse fed to the box from a hopper the outlet of which is closed by the plunger as the plunger moves through the press box in a pressing stroke, a press channel which forms an extension of the press box and into which the pressed bales are pushed by the plunger and a binding mechanism disposed between the press box and the press channel for binding the bales as they are pushed into the channel. The press is provided with a separator slide which is movable transversely to the direction of movement of the press plunger and is disposed between the press box and the press channel just upstream of the binding mechanism considered in relation to the direction of pressing movement of the plunger. The slide is movable between an operative position in the path of the plunger and a retracted position clear of this path. When in its operative position, the slide forms at one side an abutment against which the plunger presses the scrap material and has at the other side grooves formed through it for the passage of parts of a binding mechanism to enable a bale on the downstream side of the slide to be bound as it enters the channel.

4 Claims, 4 Drawing Figures

BALING PRESSES FOR THE PRODUCTION OF BOUND BALES

This invention relates to baling presses for the production of bound bales of scrap material, for example refuse. It is concerned with such presses of the kind which comprise a press box, a press plunger which is movable through the press box, a hopper which opens into the press box from above transversely to the direction of motion of the plunger and the outlet of which is closed by the plunger as the plunger moves forwards in a pressing stroke through the box, a press channel which forms an extension of the press box and a binding mechanism disposed between the press box and the press channel.

In one press of this kind which is described in German Specification No. 2,419,151 it frequently happens especially in the pressing of very moist refuse that parts of the binding mechanism get clogged with refuse during the binding operation or become unusable through dirt which is splashed around. One source of such trouble may, for example, arise with known baling presses with binding grooves which are provided in the front face of the plunger. These grooves extend vertically and as they move underneath the hopper outlet, tins or other rough pieces of refuse may penetrate into and become jammed in them. Binding needles which pass through the grooves during binding then come up against high resistance. The binding wire which lies underneath the rough pieces as it is pushed through the grooves by the binding needles may be damaged by the rough pieces or be deflected in such a way that under certain circumstances no binding at all takes place. Furthermore the rough pieces may lead to buckling of the binding needles themselves. Also even from the front face of the plunger pieces of refuse may penetrate into the grooves and clog them. This occurs particularly severely in the region of the top edge of the front face of the plunger, which is usually provided with a shear blade for shearing of the rubbish as the plunger moves past the forward edge of the hopper outlet. This device is subdivided into a number of individual knives by the grooves as is shown for example in German Specification No. 2,446,953. In particular during severance of textile or rubbery refuse material this is frequently pulled so hard into the grooves in the region of the shear blade that the binding wires, after the finish of the binding operation, can no longer leave the grooves as the plunger is retracted. This then leads to damage of the binding and hence to unusability of the bale for subsequent conveyance.

A twisting mechanism which forms part of the binding mechanism may also form a further source of trouble. Thus twisting wheels provided with twisting slots for twisting the binding wire have as a rule an outer set of teeth and are interconnected for driving purposes by gearwheels. Since the necessity for free accessibility to the twisting slots excludes close enclosure of the twisting wheels against the entry of dirt, there is the danger that, for example, upon pressing mixtures of refuse and sewage sludge, dirt may penetrate to a considerable extent into the gearing of the twisting mechanism and this finally destroys it.

The aim of the present invention is to provide a baling press of the kind described above, which does not have the disadvantages set out and ensures completion of the binding operation without jamming and with little or no susceptibility to trouble.

According to this invention, in a baling press of the kind described, a separator slide, having a mechanism by which it is movable transversely to the direction of movement of the press plunger, is provided between the press box and the press channel on the side of the binding mechanism adjacent the hopper, the slide being movable between an operative position in the path of the plunger and a retracted position clear of this path, the slide, when in its operative position, forming an abutment against which the plunger presses the scrap material.

By the provision of the separating slide, a separation is achieved of the pressing region from a binding region in the press, so that all of the components of the binding mechanism can be disposed outside the pressing region, that is clear of the forward position of the front of the plunger as the bales are pressed, and the bales are moved on in a consolidated condition, and where necessary as far as possible in a drained condition into the binding region. In this way the binding region and binding mechanism are kept essentially free of the contaminants which cause the troubles previously described.

A further advantage of the construction in accordance with the invention consists in the fact that during the binding of one bale which takes place on the side of the slide remote from the plunger, the next bale can already be getting pressed by the plunger.

In a preferred embodiment, the separator slide is provided on its side adjacent the press channel with binding grooves for the passage of binding needles which form part of the binding mechanism. In this way the binding grooves too are situated in the "clean" region of the baling press, so that the difficulties that previously occurred with them are also avoided. Hence the plunger of a baling press in accordance with the invention no longer has to be provided with any binding grooves in its front face and performs only a pressing function.

The binding grooves may lie in an operating plane of the binding mechanism, that is the plane in which the binding needles move. This construction has the advantage that the binding grooves get brought into their operative positions simultaneously with the separator slide.

As an alternative, however, the separator slide may carry a binding ram in which the binding grooves are provided, the binding ram being operable to move the binding grooves in the direction of movement of the press plunger into an operating plane of the binding mechanism, that is the plane in which the binding needles move and out of this plane in the direction of retraction of the plunger.

With this construction the binding grooves are brought into their operative binding positions only after the separator slide has reached its operating position. The advantage of this is that the binding ram with the binding grooves can be moved in the direction of forward movement of the plunger only as close as is necessary up to the bale to be bound in dependence upon conditions. In this way a taut binding can be produced, which is important particularly with bales of material which expands again only slightly after it has been pressed and bound.

Two examples of baling presses in accordance with the invention are illustrated somewhat diagrammatically in the accompanying drawings, in which.

Figure 1:
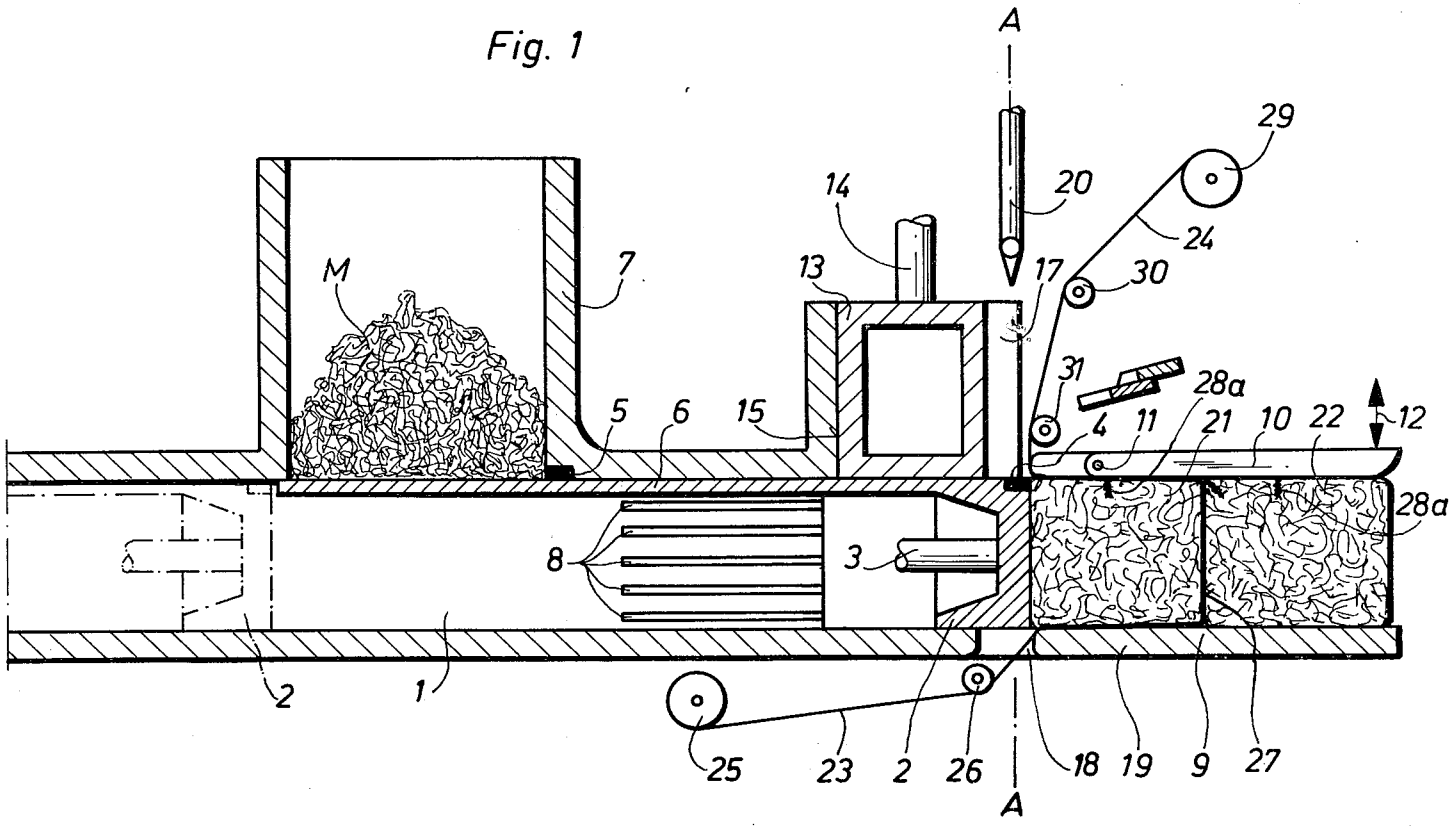
FIG. 1 is a longitudinal section through one example showing binding grooves lying in a binding plane, and a bale which has just been pushed into the binding position.

In a press box 1 of rectangular cross-section a plunger 2 is movable between a retracted position, indicated in FIG. 1 in chain-dotted lines, and a forward position shown in full ines. The plunger 2 is moved by a hydraulic cylinder of which only a piston rod 3 is indicated. At its top forward edge the plunger has a shear blade 4 which cooperates with a stationary counter-blade 5 at the front edge of the outlet of a hopper 7. With the plunger in its forward position, a panel 6 connected to the plunger closes the outlet of the hopper 7 which opens into the press box 1 from above and from which material M to be pressed into bales is fed into the press box when the plunger is retracted. One or more walls of the part of the press box which lies behind the hopper 7 in relation to the pressing direction has a number of slot-like openings 8 through which any air and/or liquid expelled from the material during pressing can escape. A press channel 9 also of rectangular cross-section is connected to the press box 1 and forms an axial extension of the box. At least the top wall 10 of the press channel 9 can be pivoted about a hinge 11 by means of a drive 12 indicated only symbolically by a double arrow, in order to be able to alter the rate at which the cross-section of the press channel 9 tapers in the pressing direction.

Between the press box 1 and the press channel 9, a separator slide 13 is movable perpendicularly to the pressing direction by means of a cylinder of which only a piston rod 14 is shown. In the position of the separator slide shown in FIG. 2, a face 15 of the slide 13 adjacent the box 1 acts as an abutment during the pressing of a bale 16. The face of the separator slide adjacent the press channel 9 is provided with vertical binding grooves 17 which lie permanently in a binding plane A—A and which register at their bottoms with ports 18 in the bottom 19 of the press channel and at their tops with binding needles 20 which are movable to and fro vertically.

At the stage of operation shown in FIG. 1 there are two pressed bales 21, 22 in the press channel 9, of which the bale 22 is already fully bound with wire, whilst the bale 21 has just been pushed by means of the plunger 2 into a binding position. In this example the bale is bound with four wires. There are therefore four similar binding mechanisms, but for the sake of simplicity only one binding mechanism is shown in the drawings. The bale 21 which is to be bound has been pushed into a loop of wire, which is formed from a bottom wire 23 and a top wire 24. The bottom wire 23 runs from a bottom stock reel 25 underneath the box 1, under a guide roller 26, through the port 18, along the bottom 19 of the press channel 9, round a front end face 27 of the bale 21, and is connected at the top of this bale by a twist 28*a* the formation of which is described later on, to the top wire 24. The wire 24 is pulled down from a stock reel 29 and led over guide rollers 30, 31.

Figure 2:
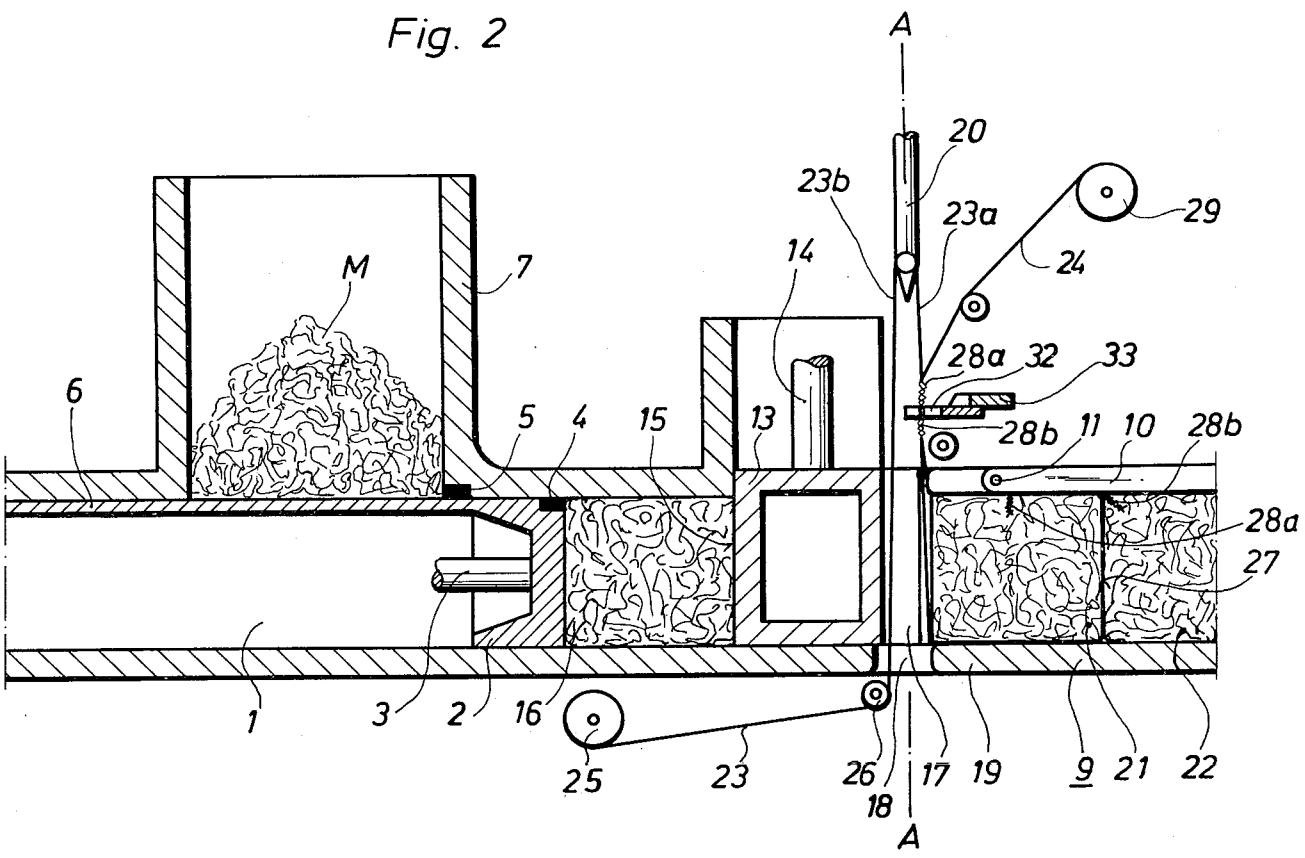
FIG. 2 is a view similar to FIG. 1, but showing the press at a different stage of operation.

At the stage of operations shown in FIG. 2, the separator slide 13 has been lowered into its lowermost position. Meanwhile the plunger has been retracted a number of times into its position shown in chain-dotted lines in FIG. 1 and moved forwards again and has thereby pressed a number of batches of material into the bale 16.

In the binding region a binding needle 20 has meanwhile been lowered through the binding grooves 17 and the port 18 and has pulled a loop 23*a*, 23*b* of the bottom wire 23 up to above the top of the press channel 9. A twisting wheel 32 has already twisted the right-hand side 23*a* of the loop 23*a*, 23*b* with the top wire 24 in such a way that above the twisting wheel there is the twist 28*a* and below the twisting wheel a twist 28*b* finally tying the bale 21. The twists 28*a*, 28*b* now still have to be severed by means of a cutting mechanism 33. After the severance of the twists 28*a* and 28*b*, the twist 28*b*, because of expansion of the bale 21 arrives in the position as shown by the example of the bale 22. The twisting and cutting mechanism preferably stays for a short time in its operative position until the binding needle 20 has been lowered far enough for the loop 23*a*, 23*b* of wire to be moved free of a catcher-hook provided on the binding needle 20, so that the sides 23*a* and 23*b* of the loop, by means of the bale which is next pushed along, become taut and the binding needle can move into its starting position. The upper twist 28*a* after pushing along of the bale has been effected, that is the bale which is in the course of preparation on the left in FIG. 2, arrives on top of the bale in a position which in the case of the bale 21 is likewise shown as 28*a*. After the conclusion of the binding operation the separator slide returns into the position shown in FIG. 1. After the plunger 2 has brought the bale 16 which has been fully pressed meanwhile, into the binding position as shown in FIG. 1, another binding operation can start.

Figure 3:
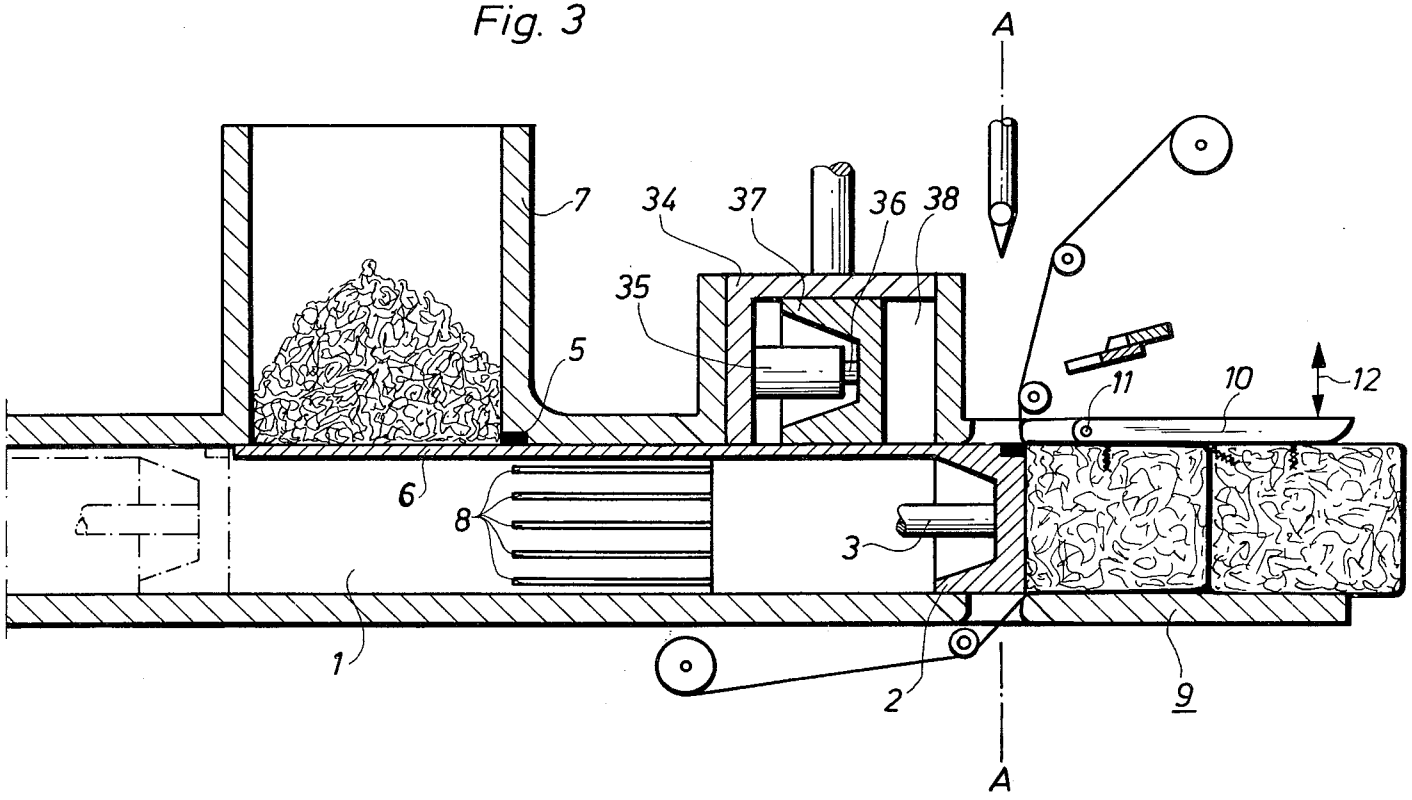
FIG. 3 is a view similar to FIG. 1 but of a second example comprising a separator slide which carries a binding ram which can be moved into the binding plane; and, FIG. 4 is a view similar to FIG. 3, but showing the press at a different stage of operation.
Figure 4:
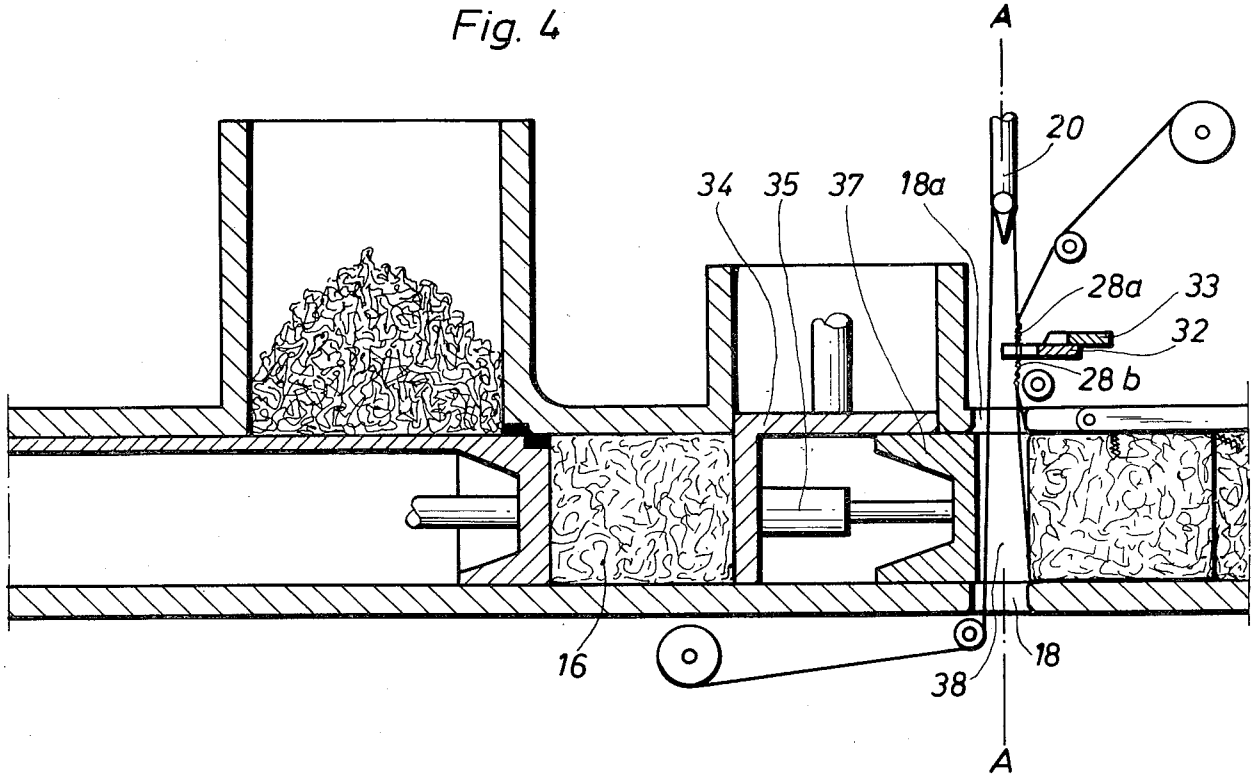

The second example shown in FIGS. 3 and 4 differs from the example of FIGS. 1 and 2 essentially only in the construction of the separator slide. This is constructed in such a way that the binding grooves do not lie permanently in the binding plane A—A but are moved into the binding plane just hefore the start of a binding operation. For this purpose a binding ram 37 which can be moved horizontally by means of a hydraulic cylinder 35 which has a piston rod 36, is supported in a vertically movable separator slide 34. The cylinder 35 in this example is attached to the separator slide and the piston rod 36 to the binding ram 37. After the bale 21 to be bound has been brought by means of the plunger 2 into the position shown in FIG. 3, which corresponds with that shown in FIG. 1, and the plunger 2 is retracted out of the region underneath the separator slide 34 and the separator slide 34 is lowered. While subsequently on the left-hand side of the separator slide, as seen in FIGS. 2 and 3, another bale 16 is being formed, the binding ram on the right-hand side is extended far enough for its binding grooves 38 to reach the binding plane A—A (FIG. 4). Then the binding operation already described with reference to the example of FIGS. 1 and 2 is carried out. In this connection, in the example illustrated in FIGS. 3 and 4, ports 18*a* in alignment and corresponding in number and dimensions with the ports 18 and the binding needles 20 are provided also in the top wall of the press channel in front, in relation to the direction of pressing, of the hinge 11.

We claim:

1. In a baling press for the production of bound bales of scrap material, said press comprising a press box, a press plunger, means mounting said press plunger for movement through said press box, a mechanism for moving said press plunger in a forward pressing movement through said press box and a retracting rearward movement out of said press box, a scrap material supply hopper, means defining an outlet from said hopper into the top of said press box, means on said plunger closing said outlet as said plunger is moved forwards through said box in a pressing movement, a press channel extending from said press box for receiving bales pressed in said press box by said plunger, and a binding mechanism disposed between said press box and said press channel, the improvement comprising a separator slide, means movably mounting said separator slide between said press box and said press channel and between said binding mechanism and said outlet of said hopper for movement transverse to said movement of said plunger, and means for moving said slide between an operative position in the path of said plunger and a retracted position clear of said path, said slide, when in said operative position, forming an abutment against which said plunger presses said scrap material as said plunger is moved forwards in a pressng movement.

2. A baling press as claimed in claim 1, further comprising means defining binding grooves in a face of said slide adjacent said press channel, and said binding mechanism including binding needles and means for moving said binding needles through said grooves when said slide is in said operative position.

3. A baling press as claimed in claim 2, wherein said binding mechanism includes an operating plane, said binding needles being movable in said operating plane and said binding grooves being disposed in said operating plane.

4. A baling press as claimed in claim 2, further comprising a binding ram, means mounting said binding ram on said separator slide for movement in a direction parallel to said movement of said press plunger, said binding grooves being provided in said binding ram, means for moving said binding ram in said direction parallel to said movement of said plunger to move said binding grooves into an operative position in an operating plane of said binding mechanism and into an inoperative position displaced from said plane in the direction of retracting movement of said plunger from said box.

* * * * *